United States Patent [19]

Kardas

[11] 4,281,982

[45] Aug. 4, 1981

[54] METHOD AND APPARATUS OF HEAT-PULSED RECUPERATION OF ENERGY

[75] Inventor: Alan Kardas, Chicago, Ill.

[73] Assignee: Institute of Gas Technology, Chicago, Ill.

[21] Appl. No.: 122,424

[22] Filed: Feb. 19, 1980

[51] Int. Cl.[3] ..... F23C 11/04

[52] U.S. Cl. ..... 431/1; 122/24

[58] Field of Search ..... 431/1, 2, 11; 122/24, 122/16, 17

[56] References Cited

U.S. PATENT DOCUMENTS

| | | | |
|---|---|---|---|
| 2,634,804 | 4/1953 | Erickson | 431/1 |
| 2,655,205 | 10/1953 | Linderoth | 431/1 |
| 2,695,053 | 11/1954 | Huber et al. | 431/1 |
| 2,878,790 | 3/1959 | Paris et al. | 431/1 |
| 2,911,957 | 11/1959 | Kumm | 431/1 |
| 3,119,436 | 1/1964 | Rydberg | 431/1 |
| 3,169,570 | 2/1965 | Haag et al. | 431/1 |
| 3,171,465 | 3/1965 | Rydberg | 431/1 |
| 3,186,381 | 6/1965 | Haag | 431/1 |
| 3,267,986 | 8/1966 | Olsson | 431/1 |
| 4,061,463 | 12/1977 | Bennett | 431/9 |

*Primary Examiner*—Samuel Scott
*Assistant Examiner*—Lee E. Barrett
*Attorney, Agent, or Firm*—Allegretti, Newitt, Witcoff & McAndrews

[57] ABSTRACT

An apparatus for heat-pulsed recuperation of energy includes a vessel defining a pulse chamber and a recuperator chamber. Gates selectively open an inlet to the pulse chamber for the introduction of the gas to the pulse chamber, open a passage for partial release of the gas from the pulse chamber to the recuperator chamber, and close the pulse chamber for confinement during compression and after release. A pulse-heat source in the pulse chamber pulse-heats the confined gas to cause the compression. Heat transfer apparatus in the chambers transfers heat from the remainder and the released portion to a heat transfer medium. A method of recuperation of heat energy, which is the method by which the apparatus operates, includes heat-pulsed compression of a confined gas. The gas is partially, adiabatically released after compression. Heat energy is recuperated by heat transfer from the released portion and the remainder.

25 Claims, 4 Drawing Figures

METHOD AND APPARATUS OF HEAT-PULSED RECUPERATION OF ENERGY

BACKGROUND OF THE INVENTION

This invention relates to a method and an apparatus for recuperating heat from, and imparting kinetic energy to, a gas or gases. More particularly, this invention relates to a method and an apparatus for heat-pulsed recuperation of heat energy, through the preheating of reactants in a high-temperature combustion process or the like.

Many high temperature industrial combustion processes end up with products of combustion at a temperature in excess of 1400 degrees Kelvin (°K.). At such a temperature, half or more of the available heat energy of the combustion products remains unutilized. While recuperation of this heat energy is desirable, the combustion gases are typically available at a pressure minimally above atmospheric pressure. As a result, the gases lack the static pressure needed for them to be passed without added propulsion through an efficient energy recovery device. Propulsion devices such as fans or blowers could conceivably provide such propulsion, but fans and blowers which could withstand the high temperature of the gases would appear to be prohibitively expensive or beyond the state of the art. Moreover, the gases are often corrosive, further limiting the conceivably useful propulsion mechanisms to those having materials capable of withstanding a corrosive atmosphere.

Because of the high-temperature resistance and corrosion resistance limitations on propulsion devices, recourse for energy recovery is typically had to tall chimneys or flues. The chimneys and flues attempt to provide a buoyant force sufficient to move the gases through open regenerator checkers and open spaces of radiant recuperators. Such tall chimneys and flues result in low gas velocities, low heat transfer rates, and minimal control over effluents for cleaning and detoxification. Thus, a need exists for improved recuperation of heat energy from the products of high temperature, industrial combustion processes and the like, and improved means for imparting kinetic energy to such products.

SUMMARY OF THE INVENTION

It is thus an object of the present invention to provide a method and an apparatus for efficient recuperation of the heat energy of products of high temperature, industrial combustion processes and the like.

Another object of the present invention is to provide an apparatus and a method for preheating the reactants of the process from which the heat energy is to be recuperated.

Another object of the present invention is to provide a method and an apparatus for recuperation of heat energy that operate without mechanical components such as fans and blowers placed in the path of high temperature process products.

Another object of the present invention is to provide a method and an apparatus for recuperation of heat energy that is suitable for the products of corrosive processes.

Another object of the present invention is to provide a method and an apparatus for recuperation of heat energy that provides for positive effluent cleaning and detoxification.

Another object of the present invention is to provide a method and an apparatus for recuperation of heat energy that is continuously operable, to accomodate continuous processes.

These and other objects and advantages are satisfied by the present invention, which in a principal aspect is a method of transferring heat from, and imparting kinetic energy to, a gas. For similicity, the term "gas" is defined to include one or more gases or gaseous products of combustion, i.e., effluents, or the like. The method is cyclical and comprises five steps. First, the gas is mixed with a hereinafter defined remainder gas to form an admixture thereof. Second, the admixture is confined, to produce a constant volume admixture. Third, heat is supplied to the constant volume admixture, to produce a heat and compressed admixture. Fourth, the heated and compressed admixture is partially released, to produce a released portion and a remainder of the heated and compressed admixture, and to impart kinetic energy to the released portion. Fifth, heat is transferred from the confined remainder to a heat transfer medium.

As preferred, the transfer of heat from the remainder lowers the pressure of the remainder to a cooled remainder pressure below the starting pressure of the gas, and sufficiently therebelow that the mixing of the gas with the remainder occurs by expansion of the gas into confinement with the remainder. Also as preferred, heat is transferred from the released portion to the heat transfer medium; heat is supplied to the confined admixture by a pulse burn; the supply of heat causes a nonisentropic pressurization; and the partial release includes a substantially adiabatic depressurization.

As most preferred, the method is carried out in an apparatus for heat-pulsed recuperation of heat energy. The apparatus includes a pressure vessel which defines a pulse chamber and a recuperator chamber, an inlet into the pulse chamber, an outlet from the recuperator chamber, and an internal passage between the chambers. An inlet gate is positioned in the inlet, for selectively opening the inlet to introduce the gas to the pulse chamber. A passage gate is located in the internal passage, for selectively opening the passage to partially release the contents of the pulse chamber into the recuperator chamber. A pulse burner is located in the pulse chamber to selectively provide an injected, pulse burn within the pulse chamber. Heat transfer apparatus is positioned in the two chambers to transfer heat from the contents of the chambers to a heat transfer medium. A controller such as an electronic timer controls the sequence and state of operation of the gates, the burner and the heat transfer apparatus, in accordance with the method of this invention.

BRIEF DESCRIPTION OF THE DRAWING

The preferred method and apparatus of the present invention are described with reference to the accompanying drawing in the following Detailed Description of the Preferred Apparatus And Method. The accompanying drawing includes four figures or views, which are briefly described as follows.

DETAILED DESCRIPTION OF THE PREFERRED APPARATUS AND METHOD

Figure 1:
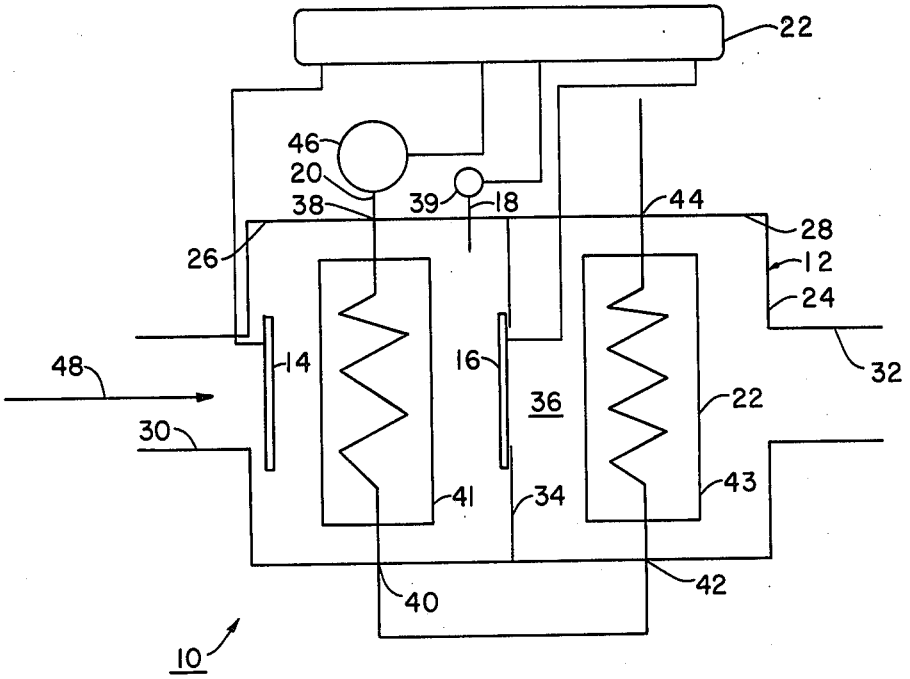
FIG. 1 is a schematic view of the preferred apparatus of the present invention, in a first stage of the preferred method.

Referring to FIGS. 1–4, the preferred apparatus of the present invention is a heat-pulsed recuperator 10. The recuperator 10 includes a pressure vessel 12, two valves or gates 14 and 16, an injector-burner 18, heat exchanger tubing 20 and a controller 22. The controller 22 is depicted in FIG. 1 only for clarity.

The vessel 12 has an outer wall 24 which defines an internal, pulse chamber 26 and an internal, recuperator chamber 28. An inlet 30 is defined into the pulse chamber 26. An outlet 32 is defined from the recuperator chamber 28. The vessel 12 has an inner wall 34 located between the chambers 26, 28. The inner wall 34 defines an internal passage 36 between the chambers 26, 28.

The gate 14 is positioned at or within the inlet 30, and the gate 16 is positioned at or within the internal passage 36. Thus, the gate 14 is an inlet gate and the gate 16 is a passage gate. Each of the gates 14, 16 is selectively operable, e.g., movable, to open and close its associated passageway. The gate 14 is operable to open and close the inlet 30, as seen by comparing FIGS. 1 and 2. The gate 16 is operable to open and close the internal passage 36, as seen by comparing FIGS. 3 and 4. As so adapted, the gate 14 constitutes a means for selectively opening and closing the inlet 30; the gate 16 constitutes a means for selectively opening and closing the passage 36.

The injector-burner 18 is positioned within the pulse chamber 26. The injector-burner 18 selectively injects and burns within the pulse chamber 26 a pre-mixed combustion mixture, such as an air-fuel mixture 37, as in FIG. 2. The combustion mixture is provided by a mixture source (not shown). The injector-burner 18 includes an ignition mechanism 39 for ignition and extingushment of the combustion mixture. Under rapid ignition and extingushment, the injector-burner 18 provides a pulse burn of the combustion mixture within the pulse chamber 26. The burning of the combustion mixture contributes heat to the contents of the pulse chamber 26, and thus, the injector-burner 18 constitutes a means for contributing or supplying heat to the contents of the pulse chamber 26. More specifically, the injector-burner 18 constitutes a means for supplying a pulse burn of the combustion mixture.

The heat exchanger tubing 20 constitutes a first means for transferring heat from the contents of the pulse chamber 26 to a heat transfer medium, and a second means for transferring heat from the recuperator chamber 28 to the medium. That is, the tubing 20, which may include one or more tubes, includes an internal passageway for a heat transfer medium. The tubing 20 has a heat exchanger portion 41 exposed within the pulse chamber 26 to the contents thereof, and a heat exchanger portion 43 exposed within the recuperator chamber 28 to the contents thereof. The tubing 20 proceeds from a medium source (not shown) to an entry opening 38 within the wall 24. The tubing 20 crosses the pulse chamber 26 to an exit opening 40. The tubing 20 then exits the chamber 26, extends along the wall 24 past the inner wall 34 and enters the recuperator chamber 28 at opening 42. After crossing the chamber 28, the tubing 20 exits the chamber 28 at opening 44, and extends to a heat utilization mechanism (not shown). Within the chambers 26, 28, the portions 41, 43 are adapted for maximum heat transfer, as schematically depicted.

The heat transfer tubing 20 includes therein a fan or blower 46. The blower 46 constitutes means for selectively propelling the heat transfer medium through the tubing 20. The blower 46 propels the medium from the medium source to the heat utilization means. The blower 46 is located adjacent the medium source, away from the temperature extreme of the heated medium exiting the chamber 28 at 44.

The controller 22 is an automatic device such as an electronic, command-generating, or electrical switch-operating, timer. The controller 22 controls the state of operation of the gates 14 and 16, the injector burner 18 and the heat exchanger blower 46, and times the sequential operation thereof. The gates 14 and 16 are selectively commanded to be open and closed. The injector-burner 18 and the blower 46 are selectively commanded to be operative, i.e., on, and non-operative, i.e., off. The sequence of commands, beginning from a state in which the gates 14 and 16 are closed and the injector-burner 18 and blower 46 are off, is a follows: (1) gate 14 open; (2) gate 14 close; (3) injector-burner 18 on; (4) injector-burner 18 off; (5) gate 16 open; (6) gate 16 close; (7) blower 46 on; and (8) blower 46 off. Thus, the controller 22 commands the gate 14 to open and close, the injector-burner 18 to ignite and extinguish, the gate 16 to open and close, and the blower 46 to provide and cease propulsion.

Each positive or activity-initiating signal of the controller 22 initiates a stage of operation of the recuperator 10. The signal to the gate 14 to open initiates a first, induction stage of operation, as in FIG. 1; the signal to the injector-burner 18 to ignite initiates a second, pulse-burn stage of operation, as in FIG. 2; the signal to the gate 16 to open initiates a third, decompression stage of operation, as in FIG. 3; and the signal to the blower 46 to provide propulsion initiates a fourth, heat transfer stage of operation, as in FIG. 4. Each of these four stages is terminated by a negative or activity-terminating signal of the controller 22. More specifically, termination of the activity of the component which initiates a stage terminates that stage. For example, termination of the pulse burn of the injector-burner 18 terminates the pulseburn stage of operation.

The recuperator 10 is an apparatus for recuperation or transfer of energy from a gas, and thus, the inlet 30 and outlet 32 communicate with a gas passageway (not shown). As most preferred, the recuperator 10 pre-heats combustion reactants of a combustion system from the heat energy of the products of combustion. As so adapted, the recuperator 10 is connected to or positioned along an outlet passage of a combustion system, e.g., the flue of a furnace (not shown). The inlet 30 is nearer the combustion area of the system than the outlet 32, and receives the products of combustion. After processing in the recuperator 10, the combustion products are expelled from the outlet 32. The combustion reactants constitute the heat transfer medium previously identified.

With reference to the recuperator 10, the preferred method, which is the method by which the recuperator 10 operates, is as follows. Preliminarily, the preferred method is cyclical and continuous. At the end of a cycle, a hereinafterdescribed remainder gas is within the pulse chamber 26, at a pressure below the starting pressure of the gas in the inlet 30. The cycle begins when the induction stage of operation is initiated. So beginning, the controller 22 and inlet gate 14 co-operatively open the inlet 30, to introduce the gas to the chamber 26. As a result of the pressure difference between the inlet 30 and the pulse chamber 26, the gas in the inlet is inducted, or expanded, into the chamber 26, as shown by arrow 48 in FIG. 1. The gas and the remainder are mixed; the gas and remainder form an admixture.

At a time sufficient for substantial equalization of pressure between the inlet 30 and the chamber 26, the controller 22 and the inlet gate 14 co-operatively close the inlet 30. The induction stage is ended. The admixture is confined at a constant volume.

Figure 2:
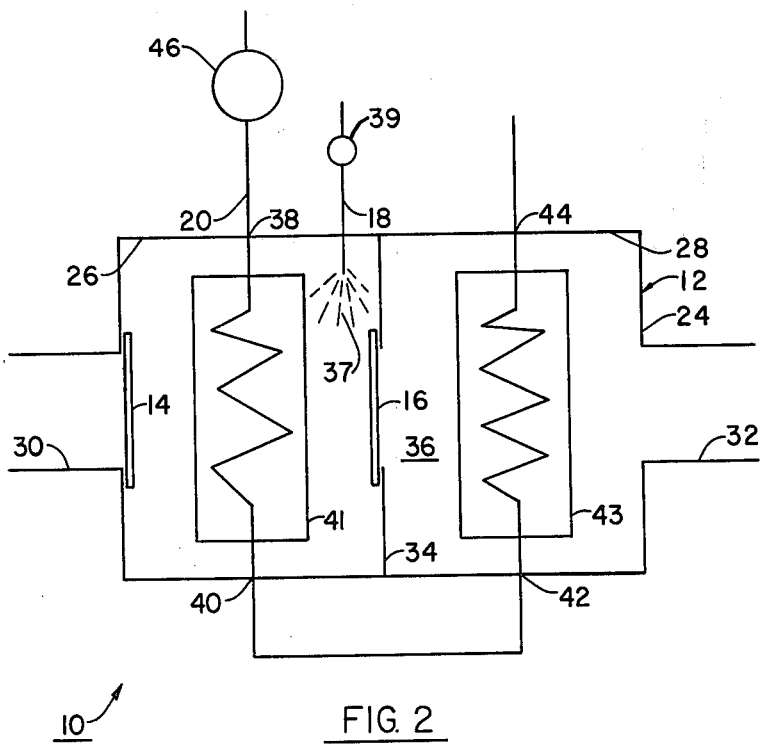
FIG. 2 is a schematic view of the preferred apparatus in a second stage of the preferred method.
Figure 3:
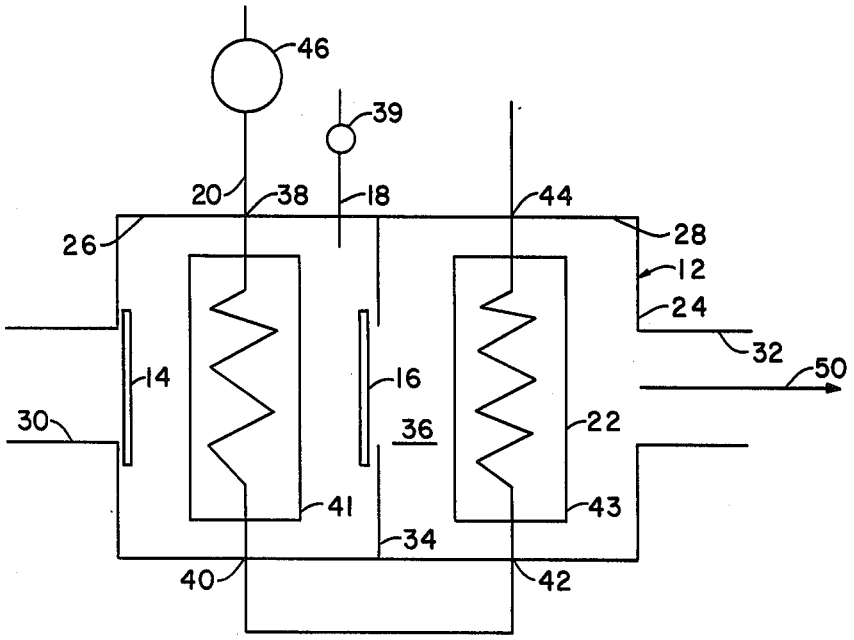
FIG. 3 is a schematic view of the preferred apparatus in a third stage of the preferred method.
Figure 4:
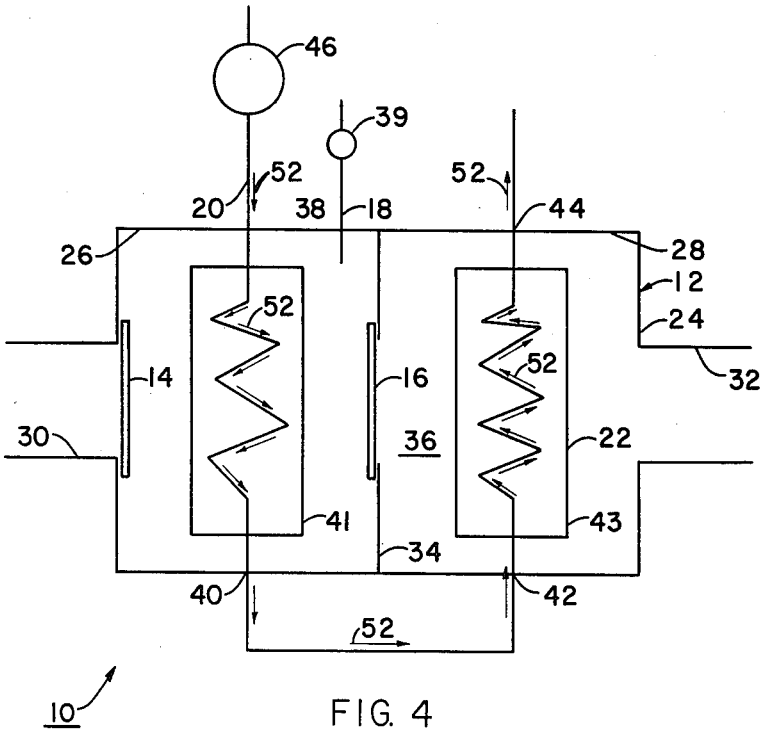
FIG. 4 is a schematic view of the preferred apparatus in a fourth and final stage of the preferred method.

The pulse burn stage of operation is initiated, as in FIG. 2. The controller 22 and the burner 18 co-operate to inject the combustion mixture into the pulse chamber 26, and ignite the mixture for a pulse burn. As a result, the admixture is non-isentropically pressurized. The temperature and pressure of the admixture are raised. The controller 22 commands the burner 18 extinguished, and the pulse burn terminates. The pulse burn stage of operation is ended, with the admixture now a heated and compressed admixture.

The decompression stage of operation begins. The controller 22 and the gate 16 co-operatively open the passage 36. A portion of the admixture is released to the recuperator chamber 28, as shown by arrow 50 in FIG. 3. The admixture expands rapidly and adiabatically to a lower pressure. The released portion of the admixture is imparted with a kinetic energy by the expansion. The gate 16 closes on command of the controller 22, and the non-released remainder of the admixture is re-confined. The decompression ends.

The controller 22 commands the blower 46 into operation, and the heat transfer stage of operation begins. The heat transfer medium is circulated through both chambers 26, 28, within the tubing 20, as shown by the arrows exemplarily marked 52 in FIG. 4. Heat is transferred to the medium from the confined remainder in the chamber 26 and the released portion in the chamber 28. The transfer from the remainder lowers the pressure in the chamber 26 to a cooled remainder pressure below the starting pressure in the inlet 30, and the cycle is ended. The released portion of the admixture moves out the outlet 32, as shown by arrow 54 in FIG. 4.

Intermittent operation of the blower 46 described above is not essential to the heat transfer aspect of the invention. The thermal inertia of the recuperative system and the magnitude of the temperature differentials gas-to-heat transfer medium are such that a continuous flow of the heat transfer medium will serve equally well.

The preferred apparatus and method are now described. With the apparatus and method as described, significant quantities of gas are effectively supplied with substantial kinetic energy and a highly desirable recuperation of heat is achieved.

EXAMPLE

The products of a methane combustion process burned with 110% theoretical air result, after yielding work to a high temperature process, in a flue gas at atmospheric pressure (101,325 Pa), a temperature of 1367 degrees Kelvin (°K.) and mass ratios of fuel to air to flue gas of 1/18.876/19.876. A combustion reactant temperature of 1089° K., or an increase of 800° from an ambient 289° K., is desired, as is a reduction of the flue gas temperature to 755° K. A firing rate of the combustion reactants of 0.336 megawatts is also desired. The combustion reactant to be preheated is air.

The flue gas density at 1367° K. is 0.245 kilograms (kg) per cubic meter. A mass of 0.454 kg of flue gas is examined. A cubic chamber volume of 0.454/0.245 cubic meters ($m^3$), or 1.853 $m^3$, is selected, as is a gate having a free flow area equivalent to the total inner wall 34 of the vessel 12. With a fuel gas for the injector-burner 18 having a heating value of 50 megajoules per kilogram and a stoichiometric air-fuel mass ratio of the combustion mixture of 18.2 kg air/kg fuel, a pulse burn of 10 grams of the combustion mixture results in a temperature increase in the pulse chamber 26 of 60° K. and a pressure increase of 6800 Pa. An adiabatic decompression of the admixture in the first chamber for 0.0017 seconds (s) (the approximate time for the rarefaction wave to cross the chamber 26) results in a release of 1/34 of the admixture volume, with a temperature in the recuperator chamber 28 of 1401° K. At the firing rate of 0.336 MW, a pulse frequency of 10 Hz is needed. Heat transfer is effected through 235 1 cm diameter tubes crossing the chambers 26, 28 and the temperature and pressure of the remainder become 1365° K. and 98,862 Pa, respectively. The remainder pressure is 2462 Pa below the starting pressure in the inlet 30, and the time of induction is about 0.094 s. Gate dead time is not accounted, because of potential increases in heat transfer surface and firing rate.

The working sequence is as follows:

| STEP (at end): | Pulse Burn | Decom-pression | Heat Transfer | Induction |
|---|---|---|---|---|
| Temperature (°K.) | 1427 | 1401 | 1365 | 1367 |
| Pressure (Pa) | 108,125 | 101,325 | 98,862 | 101,325 |
| Mass (g) | 464 | 443 | 443 | 454 |

The net movement of gas is 11 g per cycle, or 110 g/s at 10 Hz. One hundred ten percent of the air needed for combustion is preheated to 1089° K., at a fuel saving of 40% over combustion without preheating. Seventy-one percent of the gross heating value of the combustion reactants is utilized.

As should now be apparent, a highly useful method and apparatus of heat-pulsed recuperation of heat energy are disclosed. Within the ordinary skill in the art, various modifications could be made to the preferred method and apparatus. Therefore, to particularly point out and distinctly claim the subject matter regarded as invention, the following claims conclude this specification.

What is claimed is:

1. A method of recuperating heat from, and imparting kinetic energy to, a gas, comprising the steps of:

(a) mixing the gas with a hereinafter-defined remainder to form an admixture thereof;

(b) confining the admixture, to produce a constant volume, confined admixture;

(c) supplying heat to the confined admixture, to produce a heated and compressed admixture;

(d) partially releasing the heated and compressed admixture, to produce a released portion and a confined remainder of the heated and compressed admixture, and to impart kinetic energy to the released portion; and (e) transferring heat from the confined remainder to a transfer medium.

2. A process as in claim 1 wherein the gas has a starting pressure and the step of transferring heat from the confined remainder lowers the pressure of the confined remainder to a cooled remainder pressure below the starting pressure of the gas.

3. A process as in claim 2 wherein the step of transferring heat from the confined remainder lowers the cooled remainder pressure sufficiently below the starting pressure that the step of mixing the gas with the confined remainder may include expansion of the gas into confinement with the confined remainder.

4. A process as in claim 3 wherein the step of mixing the gas with the confined remainder includes expansion of the gas into confinement with the confined remainder.

5. A process as in claim 1 further comprising the step of transferring heat from the released portion to the transfer medium.

6. A process as in claim 1 wherein the step of supplying heat to the confined admixture includes a pulse burn of a combustion mixture.

7. A process as in claim 1 wherein the step of supplying heat to the confined admixture causes a substantially nonisentropic pressurization of the admixture.

8. A process as in claim 1 wherein the step of partially releasing the heated and pressurized admixture includes a substantially adiabatic depressurization of the heated and pressurized admixture.

9. An apparatus for heat-pulsed recuperation of heat energy from a gas comprising:

a pressure vessel defining a pulse chamber providing for confining a hereinafter-defined admixture to produce a constant volume, confined admixture, a recuperator chamber, an inlet to the pulse chamber, an outlet from the recuperator chamber and an internal passage between the pulse chamber and the recuperator chamber;

means connected to the vessel for selectively closing and opening the inlet, to selectively introduce the gas to the pulse chamber providing for mixing the gas with a hereinafter-defined remainder to form the admixture;

means extending into the pulse chamber for supplying heat to the confined admixture in the pulse chamber to produce a heated and compressed admixture;

means connected to the vessel for selectively closing and opening the internal passage to selectively, partially release the heated and compressed admixture, to produce a released portion and a confined remainder of the heated and compressed admixture and to impart kinetic energy to the released portion; and means extending into the pulse chamber for transferring heat from the confined remainder in the pulse chamber to a transfer medium, whereby the gas is mixed with the remainder to form the admixture, the admixture is confined to produce the constant volume, confined admixture, heat is supplied to the confined admixture to produce the heated and compressed admixture, the heated and compressed admixture is partially released to produce the released portion and the confined remainder of the heated and compressed admixture and to impart kinetic energy to the released portion, and heat is transferred from the confined remainder to the transfer medium.

10. An apparatus as in claim 9 wherein the means for selectively closing and opening the inlet includes an inlet gate.

11. An apparatus as in claim 9 wherein the means for selectively closing and opening the internal passage includes a passage gate.

12. An apparatus as in claim 9 wherein the means supplying heat to the confined admixture in the pulse chamber includes means for supplying a pulse burn of a combustion mixture in the pulse chamber.

13. An apparatus as in claim 12 wherein the means for supplying a pulse burn comprises means for injecting into the pulse chamber and igniting therein a combustion mixture.

14. An apparatus as in claim 9 wherein the means for transferring heat comprises heat transfer tubing in the pulse chamber.

15. An apparatus as in claim 9 further comprising means for transferring heat from the released portion in the recuperator chamber to the heat transfer medium.

16. An apparatus as in claim 15 wherein the means for transferring heat from the released portion in the recuperator chamber comprises heat transfer tubing in the recuperator chamber.

17. An apparatus as in claim 9 further comprising means for propelling the heat transfer medium through the heat transfer means.

18. An apparatus as in claim 9 further comprising means for controlling the opening and closure of the means for selectively closing and opening the inlet.

19. An apparatus as in claim 9 further comprising means for controlling the opening and closure of the means for selectively opening and closing the internal passage.

20. An apparatus as in claim 9 further comprising means for controlling the heat transfer means.

21. An apparatus for heat pulsed recuperation of heat energy from a gas comprising:

a pressure vessel defining a pulse chamber, a recuperator chamber, an inlet to the pulse chamber, an outlet from the recuperator chamber and an internal passage between the pulse chamber and the recuperator chamber;

means for selectively closing and opening the inlet, to selectively introduce the gas to the pulse chamber;

means for selectively closing and opening the internal passage, to selectively, partially release the contents of the pulse chamber to the recuperator chamber;

means for supplying heat to the gas in the pulse chamber;

means for transferring heat from the gas in the pulse chamber to a transfer medium;

means for igniting and extinguishing the means for supplying heat; and means for (a) controlling (1) the opening and closure of the means for selectively closing and opening the inlet; (2) the opening and closure of the means for selectively opening and closing the internal passage; (3) the means for igniting and extinguishing the means for supplying heat; and (4) the operation of the means for transferring heat, and (b) timing the operation of (1) the opening and closure of the means for selectively closing and opening the inlet; (2) the opening and closure of the means for selectively opening and closing the internal passage; (3) the means for igniting and extinguishing the means for supplying heat; and (4) the operation of the means for transferring heat, and to provide a sequential operation of (1) opening of the inlet; (2) closing of the inlet; (3) ignition of the means for supplying heat; (4) extinguishment of the means for supplying heat; (5) opening of the passage; (6) closure of the passage; (7) initiation of heat transfer; and (8) termination of heat transfer.

22. An apparatus as in claim 21 wherein the means for igniting and extinguishing the heat supply means and the controlling means provide a pulse burn to pulse-heat and compress the contents of the pulse chamber.

23. An apparatus as in claim 22 wherein the means for selectively opening and closing the internal passage and the controlling means co-operatively open the passage to provide an adiabatic decompression of the heated and compressed contents of the pulse chamber.

24. An apparatus as in claim 21 wherein the controlling means and the means for selectively opening and closing the inlet co-operatively close the inlet upon substantial equalization of the pressure within the pulse chamber and the inlet.

25. An apparatus as in claim 21 wherein the controlling means and the means for transferring heat co-operatively transfer heat to the transfer medium until the pressure within the pulse chamber is lower than the pressure within the inlet.

* * * * *